US010667031B2

(12) United States Patent
Hiipakka

(10) Patent No.: US 10,667,031 B2
(45) Date of Patent: May 26, 2020

(54) EARPIECE FOR ACOUSTICAL SOURCE AND LOAD MODELING

(71) Applicant: Hefio Oy, Espoo (FI)

(72) Inventor: Marko Hiipakka, Espoo (FI)

(73) Assignee: Hefio Oy, Espoo (FI)

( * ) Notice: Subject to any disclaimer, the term of this patent is extended or adjusted under 35 U.S.C. 154(b) by 68 days.

(21) Appl. No.: 15/737,559

(22) PCT Filed: Jun. 17, 2016

(86) PCT No.: PCT/FI2016/050444
§ 371 (c)(1),
(2) Date: Dec. 18, 2017

(87) PCT Pub. No.: WO2016/203117
PCT Pub. Date: Dec. 22, 2016

(65) Prior Publication Data

US 2019/0124434 A1 Apr. 25, 2019

(30) Foreign Application Priority Data

Jun. 18, 2015 (FI) ..... 20155478

(51) Int. Cl.
*H04R 1/10* (2006.01)
*H04R 29/00* (2006.01)

(52) U.S. Cl.
CPC ..... *H04R 1/1041* (2013.01); *H04R 1/1016* (2013.01); *H04R 1/1075* (2013.01); *H04R 1/1091* (2013.01); *H04R 29/00* (2013.01); *H04R 29/001* (2013.01)

(58) Field of Classification Search
CPC .. H04R 25/70; H04R 2460/05; H04R 29/001; H04R 25/30
See application file for complete search history.

(56) References Cited

U.S. PATENT DOCUMENTS 4,827,525 A * 5/1989 Hotvet ..... H04R 25/60 381/60
5,105,822 A 4/1992 Stevens et al.
5,761,314 A 6/1998 Inanaga et al.
2012/0020493 A1 1/2012 Andre
2013/0121518 A1 5/2013 Dahl
(Continued)

FOREIGN PATENT DOCUMENTS

EP 2552125 A1 1/2013
WO 91/11078 A1 7/1991
(Continued)

OTHER PUBLICATIONS

International Search Report prepared by the European Patent Office for PCT/FI2016/050444, dated Oct. 7, 2016, 4 pages.
(Continued)

*Primary Examiner* — Kile O Blair
(74) *Attorney, Agent, or Firm* — Chernoff Vilhauer LLP

(57) ABSTRACT

A wearable device configured to be modeled as both a part of the source and a part of the load in an electro-acoustical source-and-load model of a system where a sound source is coupled to the ear canal. Such a wearable device may be used to determine the acoustic energy density at a point of measurement in or near the ear of a user.

20 Claims, 6 Drawing Sheets

(56) References Cited

U.S. PATENT DOCUMENTS

| | | | |
|---|---|---|---|
| 2014/0126734 | A1 | 5/2014 | Gauger, Jr. et al. |
| 2014/0341388 | A1 | 11/2014 | Goldstein et al. |

FOREIGN PATENT DOCUMENTS

| | | | |
|---|---|---|---|
| WO | 2009015210 | A2 | 1/2009 |
| WO | 2012165976 | A1 | 12/2012 |

OTHER PUBLICATIONS

Search Report prepared by the Finnish Patent and Registration Office for FI 20155478, dated Jan. 7, 2016, 1 page.

Per-Anders Hellstrom et al: "Miniature microphone probe tube measurements in the external auditory canal", The Journal of the Acoustical Society of America, American Institute of Physics for the Acoustical Society of America, vol. 93, No. 2, pp. 907-919, XP012188248, ISSN: 0001-4966, DOI: 10.1121/1.405452, New York, NY, US.

Hefio OY, Communication pursuant to Article 94(3) EPC, Nov. 8, 2019, Helsinki, Finland.

* cited by examiner

EARPIECE FOR ACOUSTICAL SOURCE AND LOAD MODELING

CROSS-REFERENCE TO RELATED APPLICATIONS

This is a national stage application filed under 35 USC 371 based on International Application No. PCT/FI2016/050444 filed Jun. 17, 2016 and claims priority under 35 USC 119 of Finnish Patent Application No. 20155478 filed Jun. 18, 2015.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

The present invention relates to acoustical modeling of sound sources. Preferred embodiments may be coupled to the ear canal. In particular some embodiments relate to a wearable device configured to be modeled as both a part of the source and a part of the load in an electro-acoustical source-and-load model of a system where a sound source is coupled to the ear canal. Such a wearable device may be used to determine the acoustic energy density at a point of measurement in or near the ear of a user. An earpiece according to an embodiment according to the present invention comprises a tube and acoustic sensors.

BACKGROUND ART

Headphones produce different frequency responses for different users due to the individual characteristics of the user's ears. In order to achieve an optimized and similar frequency response for all users the headphones should be calibrated, i.e., equalized individually. The headphone transfer function (HpTF) describes how the sound is filtered by the ear on its path from the sound source to the eardrum. With appropriate individual HpTF's available, the headphones can be equalized using the HpTF's as filters to produce a flat frequency response at the eardrum. Consequently, an audio signal having a flat spectrum will produce a flat frequency response at the eardrum after the HpTF filtering and playback through the headphones in question. With conventional headphones the HpTFs are very difficult to measure and professional equipment is needed for the task. It is therefore an aim of certain embodiments of the present invention to provide accurate measurement of acoustic energy for the estimation of HpTF's and calibration of sound sources.

BRIEF SUMMARY OF THE INVENTION

The aim of some embodiments of the present invention is achieved with aid of a novel earpiece. An earpiece according to certain embodiments of the present invention allows for the measurement of acoustic energy density at or near the ear of an individual. Such measurement may provide for the calibration of sound sources.

Considerable benefits are gained with aid of the present invention.

According to an embodiment of the invention there is an earpiece. The earpiece comprises a tube (1) an acoustic sensor (10) and an attachment means. The tube (1) may have a first opening (4) at a first end and a second opening (5) at a second end. The acoustic sensor (10) may be coupled to the tube (1) so as to be capable of measuring properties of sound inside the tube (1). The acoustic sensor (10) may also be arranged to measure sound within the tube at a point which is at least 2 mm from both the first opening (4) and the second opening (5). The attachment means may be for attaching the earpiece to an ear of a user. The second end of the earpiece may be capable of being at least partially inserted into the ear of a person.

The attachment means may be a deformable portion of the earpiece for compression fit-ting of the earpiece at least partially inside the ear of a person. The attachment means may also be the shape of the earpiece which is formed so as to fit snuggly within the concha of a person.

Certain embodiments of the present invention further comprise a transducer (20) coupled to the tube (1) at the first opening (4).

In some embodiments of the present invention the earpiece is configured to be inserted into the ear of an individual such that the second opening (5) is less than 4 mm from the entrance of the ear canal of the individual.

Within certain embodiments of the present invention the earpiece comprises a tube (1) which is shaped such that, excluding terminal ends of the tube (1), the largest flaring angle of the inner wall (3) of the tube is less than 10 degrees, preferably less than 6 degrees, most preferably less than 4 degrees.

BRIEF DESCRIPTION OF THE SEVERAL VIEWS OF THE DRAWINGS

In the following, exemplary embodiments of the invention are described in greater detail with reference to the accompanying drawings in which.

DETAILED DESCRIPTION OF THE INVENTION

Figure 1B:
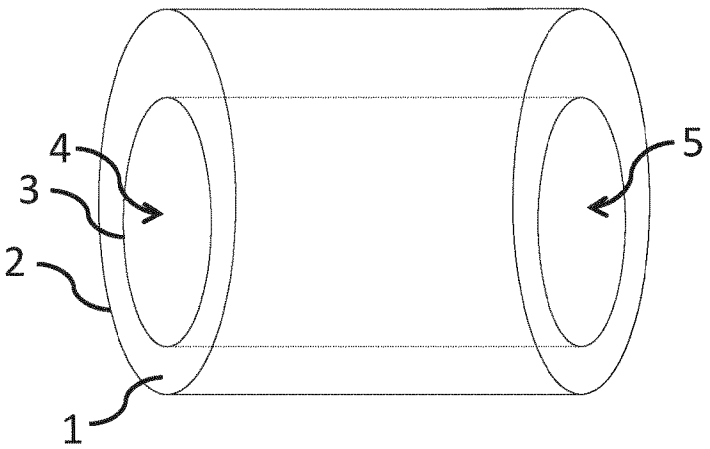
FIGS. 1*a* through 1*d* provide various views of a tube according to an embodiment of the invention.
Figure 1D:
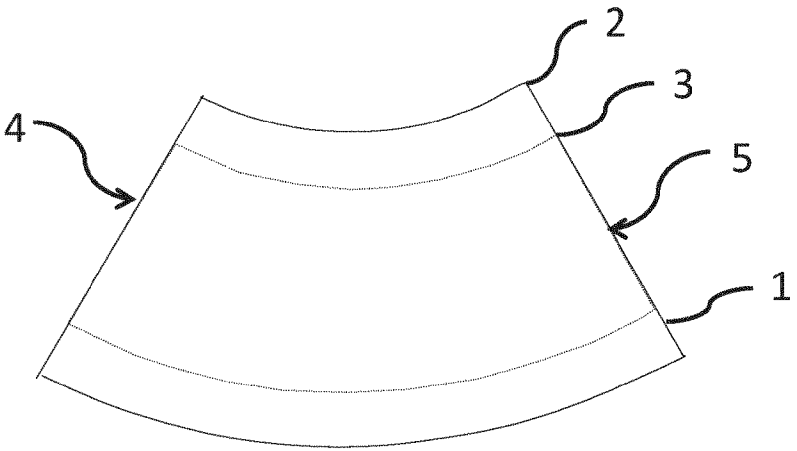

FIGS. 1*a* through 1*d* show various views of a tube (1) according to an embodiment of the invention. The tube (1)

has a first opening (4) at a first end and a second opening (5) at a second end. The tube has an inner wall (3) and an outer wall (2). In certain embodiments of the invention the cross sectional area surrounded by the inner wall (3) of the tube is between is between 3 $mm^2$ and 79 $mm^2$, preferably between 8 $mm^2$ and 38 $mm^2$.

Figure 1A:
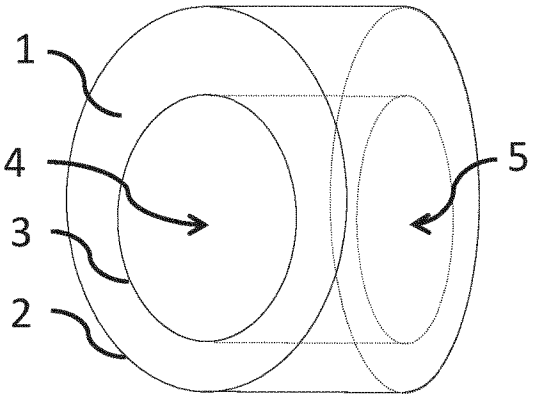
Figure 1C:
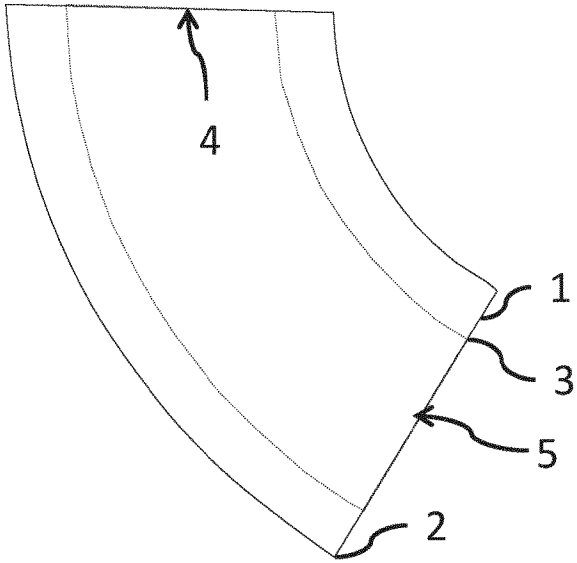

As seen in FIGS. 1*a* through 1 *d* the openings are located at opposing ends of the tube. The opening may be defined as the plane at which the tube ends. The openings may also be defined as planes perpendicular to the inner wall (3) of the tube where the tube material stops. The opening may also be defined as the plane perpendicular to the outer wall (2) of the tube where the tube material stops. The openings may be coupled to further sections of tube. The opening may also be defined as a plane at the edge of the tube.

Figure 2A:
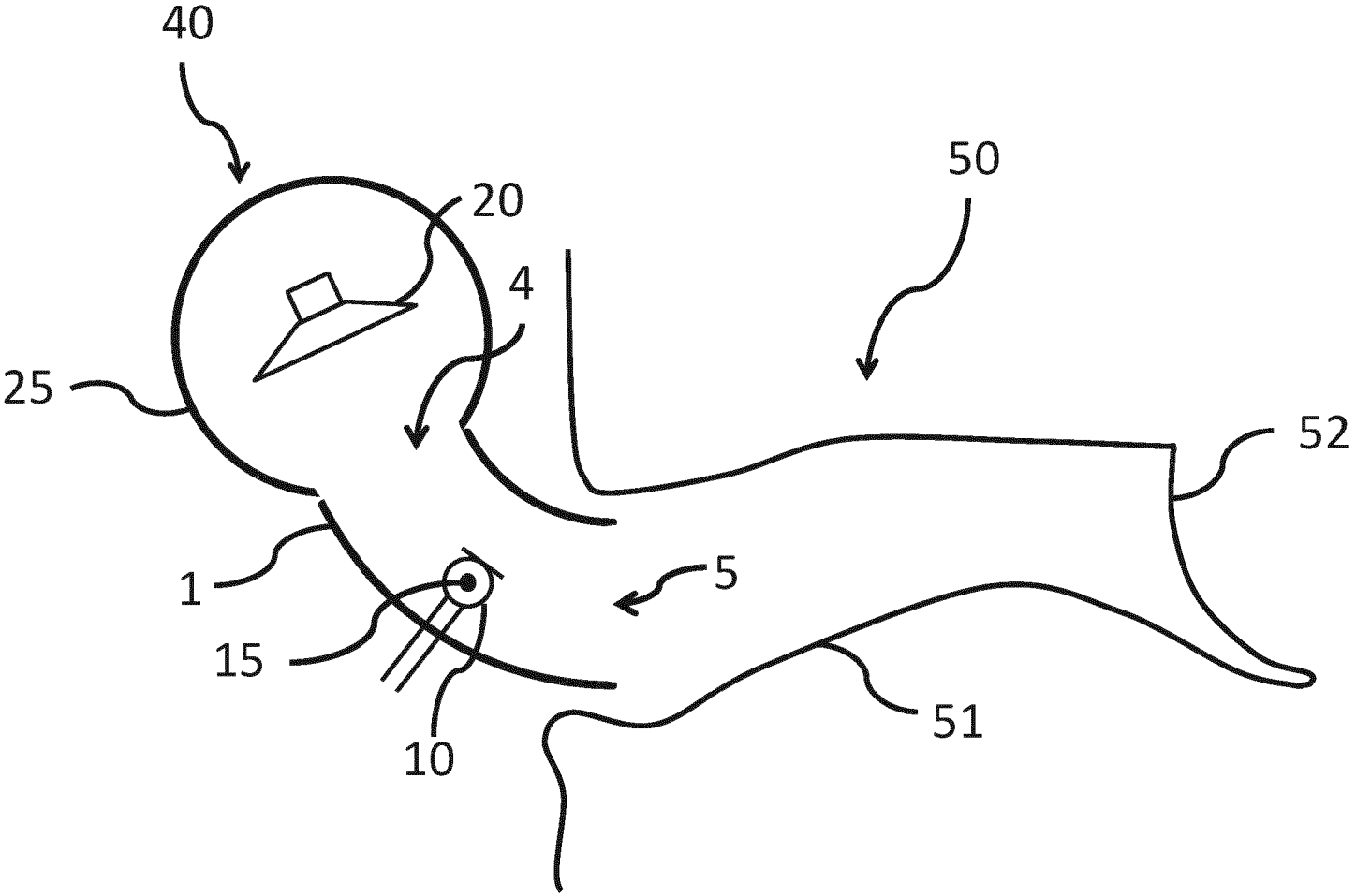
FIGS. 2*a* and 2*b* show an earpiece according to an embodiment of the invention.
Figure 2B:
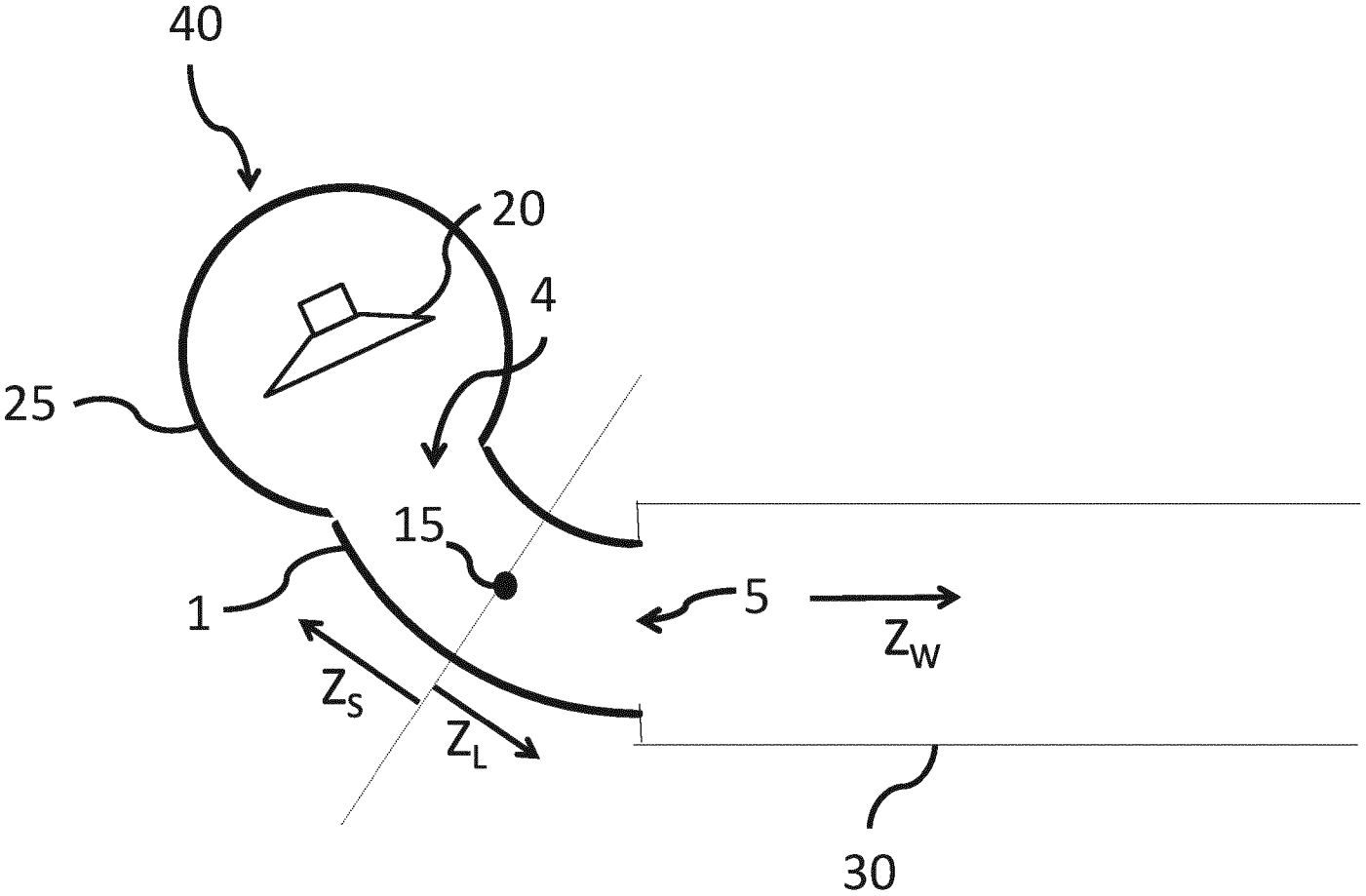
Figure 3A:
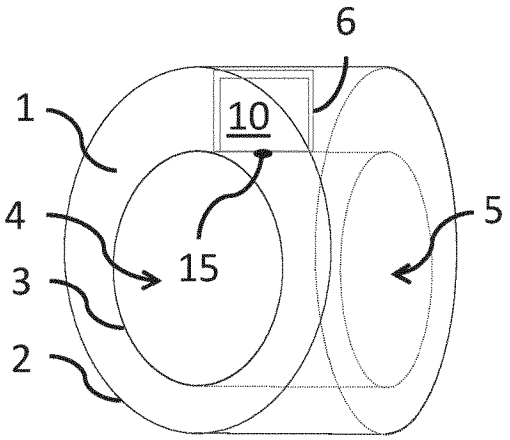
FIGS. 3*a* through 3*d* provide various views of a tube according to an embodiment of the invention.
Figure 3B:
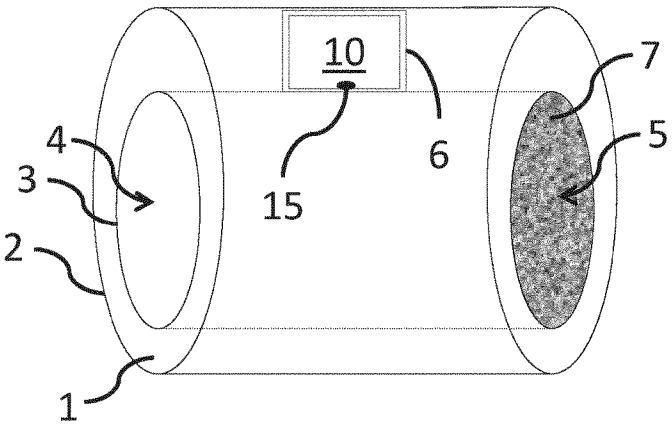
Figure 3C:
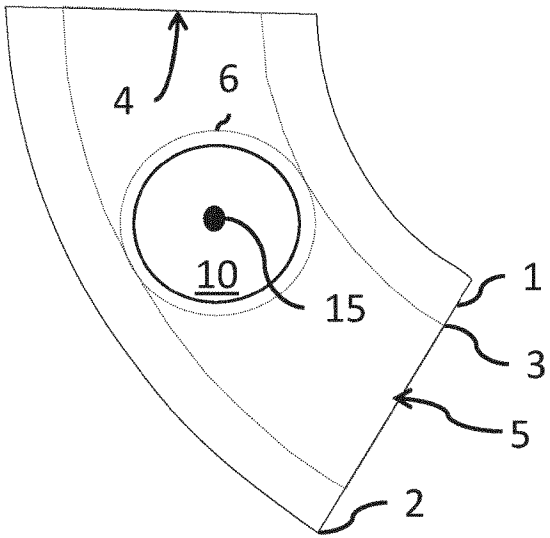
Figure 3D:
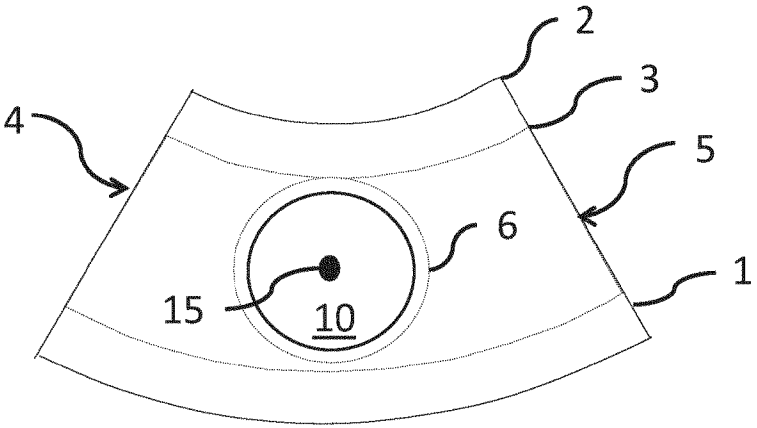

FIGS. 2*a* and 2*b* show an earpiece (40) according to an embodiment of the invention. In the embodiment according to FIGS. 2*a* and 2*b* there is coupled to the tube a transducer (20). The transducer (20) is coupled to the first opening (4) of the tube. The transducer (20) is coupled to the tube (1) at the first opening (4) so as to direct sound through the tube (1). The transducer (20) is further surrounded by a housing (25). The housing (25) is coupled to the tube (1) at or about the first opening (4). In certain embodiments the transducer (20) may be coupled to the housing (25).

In certain embodiments of the present invention the earpiece is curved. The curvature of the earpiece can be adapted to accommodate the ear of an individual. In embodiments where the earpiece is curved it is not necessary that the tube also be curved.

In some embodiment of the present invention the tube portion is straight and the other portions of the earpiece are adapted to accommodate the ear of an individual.

In certain embodiments of the present invention the smallest radius of curvature of the tube, as measured from the center of the tube, is greater than the smallest diameter of the tube. In other embodiments the smallest radius of curvature of the tube, as measured from the center of the tube, is preferably greater than one and a half times the smallest diameter and most preferably two and a half times the smallest diameter. Limiting the radius of curvature of the tube ensures unimpeded planar sound transmission.

In FIG. 2*a* there is an acoustic sensor (10) coupled to the tube (1) so as to be capable of measuring properties of sound inside of the tube (1). The acoustic sensor (10) is configured such that there is at least 2 mm between a point of measurement (15) and both the first opening (4) and the second opening (5). The acoustic sensor (10) may also be configured such that there is at least 3 mm between the point of measurement (15) and both the first opening (4) and the second opening (5). In certain embodiments it is preferable that at least 4 mm is between the point of measurement (15) and both the first opening (4) and the second opening (5). Most preferably there is at least 7 mm between the point of measurement (15) and both the first opening (4) and the second opening (5).

FIG. 2*a* further illustrates the ear canal of an individual (50). The ear canal of the individual has a canal part (51) and an eardrum part (52). The earpiece (40) of FIG. 2*a* is configured to be at least partially inserted into the ear canal of an individual (50). In the embodiment according to FIG. 2*a* the earpiece (40) is configured such that the second opening (5) is inside of the canal part (51).

FIG. 2*b* further illustrates an earpiece (40) according to certain embodiments of the invention coupled to an external load impedance tube (30) having a known impedance $Z_W$. During the modeling of the electroacoustical source parameters, sounds are provided via the transducer (20) in order to determine Thévenin type source parameters $P_S$ (pressure source) and $Z_S$ (source impedance). The sounds provided may be in the form of sweeps.

As shown in FIG. 2*b*, a first portion of the tube (1) between the point of measurement (15) and the second opening (5) is considered part of the load impedance $Z_L$. Furthermore, everything to the right side of the point of measurement (15) is considered to be part of the load impedance $Z_L$. The portion of the tube (1) opposite the first portion from the point of measurement (15) is considered part of the source impedance $Z_S$.

According to certain embodiments of the invention the geometric properties of the tube are such that the acoustic impedance of a progressive plane wave in the tube (1), at any point between the first opening (4) and the second opening (5), is between 5 and 137 MPa*s/$m^3$, preferably between 18 and 67 MPa*s/$m^3$ and most preferably between 34 and 46 MPa*s/$m^3$.

In certain embodiments of the invention the earpiece is configured to be inserted into the ear of an individual such that the second opening (5) is less than 4 mm from the entrance of the ear canal of the individual.

According to certain embodiments of the invention the maximum flaring angle of the inner wall (3) of the tube is limited to less than 10 degrees. Limiting the flaring angle helps to ensure that there are no rapid changes in diameter within the tube. Eliminating these rapid changes ensures that there is laminar flow of sound waves within the tube and that the flow of sound is not disrupted substantially. In at least some embodiments of the present invention, excluding terminal ends of the tube (1), the largest flaring angle of the inner wall (3) of the tube is less than 10 degrees. Preferably the largest flaring angle of the inner wall (3) of the tube is less than less than 6 degrees. Most preferably the largest flaring angle of the inner wall (3) of the tube is less than 4 degrees.

FIGS. 3*a* through 3*d* illustrate a tube according to certain embodiments of the invention further comprising a recess (6) in the tube (1). In the embodiments shown in FIGS. 3*a* through 3*d* the recess (6) is in the inner wall (3) of the tube. The acoustic sensor (10) is positioned at least partially inside of the recess (6). When a recess (6) is provided in the inner wall (3) of the tube the largest flaring angle of the inner wall (3), excluding the recess and the terminal ends is less than 10 degrees, preferably less than 6 degrees and most preferably less than 4 degrees.

As illustrated in FIGS. 3*a* through 3*d* the tube further comprises a substantially acoustically transparent material (7) coupled to the second opening (5) so as to prevent particulate matter from entering the tube (1). The substantially acoustically transparent material (7) may be, for example, GORE® Acoustic Vent. The specifications of the GORE® Acoustic Vent GAW111 are available at www.gore.com/MungoBlobs/514/333/PEV-Acoustic-Product-Datasheet-US-AUG11_e.pdf and are incorporated herein by reference. The material properties of the substantially acoustically transparent material (7) is such that the frequency response to acoustic energy measured at a first side of the material upon supply of acoustic energy at the first side is within 3 dB of a frequency response of acoustic energy measured at a second side of the material. Preferably the frequency response of acoustic energy measured at the first side would be within 2 dB of a frequency response of acoustic energy measured at a second side of the material and most preferably within 1 dB.

As seen in FIGS. 3*a* through 3*d* the point of measurement (15) may be at the center of the acoustic sensor (10). In certain embodiments of the present invention the acoustic sensor (10) senses either acoustic pressure or particle velocity. The acoustic sensor may be a microphone. The acoustic sensor may also be a particle velocity sensor. In embodiments where the acoustic sensor is a microphone the point of measurement (15) may be at the center of a face of the microphone.

In certain embodiments of the invention the acoustic sensor (10) may be coupled to a sensor tube. Said sensor tube is coupled to the tube of the earpiece such that one opening of the sensor tube is at the inner surface of the tube of the earpiece. The center of the opening of the sensor tube at the inner surface of the tube of the earpiece may serve as the point of measurement.

An earpiece according to certain embodiments of the invention is configured to be worn by an individual. The earpiece may be configured to be self-supporting. An earpiece according to certain embodiments may be configured to fit inside the concha of an individual.

Figure 4B:
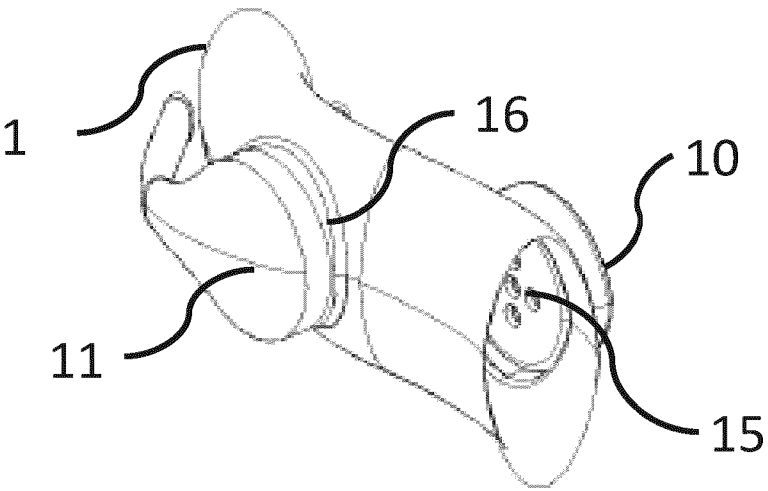
FIGS. 4*a* and 4*b* show various views of an earpiece having two acoustic sensors according to an embodiment of the invention.
Figure 4A:
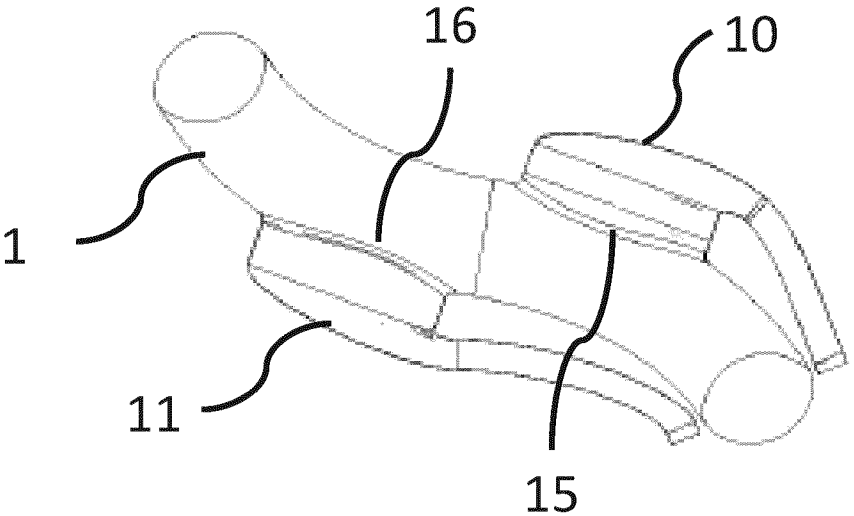

As shown in FIGS. 4*a* and 4*b* earpieces according to certain embodiments of the present invention further have an additional acoustic sensor (11) coupled to the tube (1) so as to be capable of measuring properties of sound inside of the tube at an additional point of measurement (16) at least 4 mm and preferably between 10 mm and 20 mm from the first point of measurement (15).

Figure 5B:
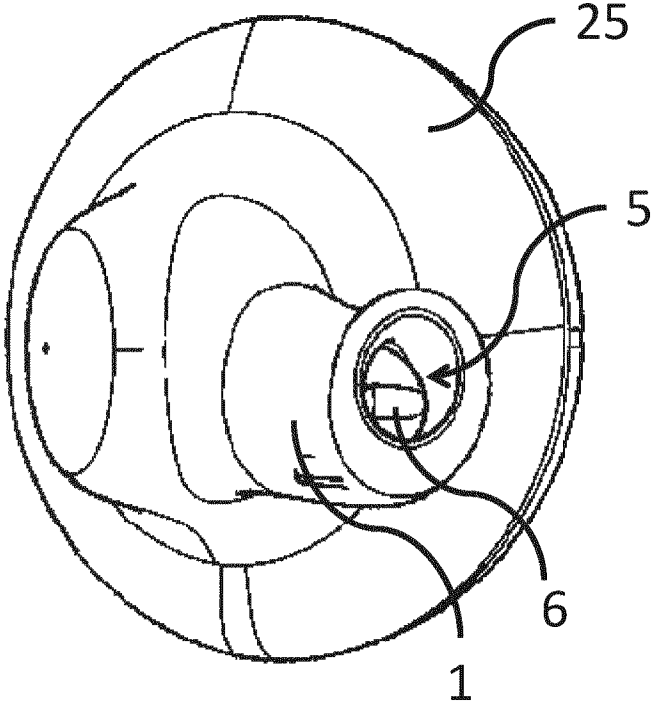
FIGS. 5*a* and 5*b* show an earpiece according to certain embodiments of the present adapted to fit at least partially into the ear of an individual.
Figure 5A:
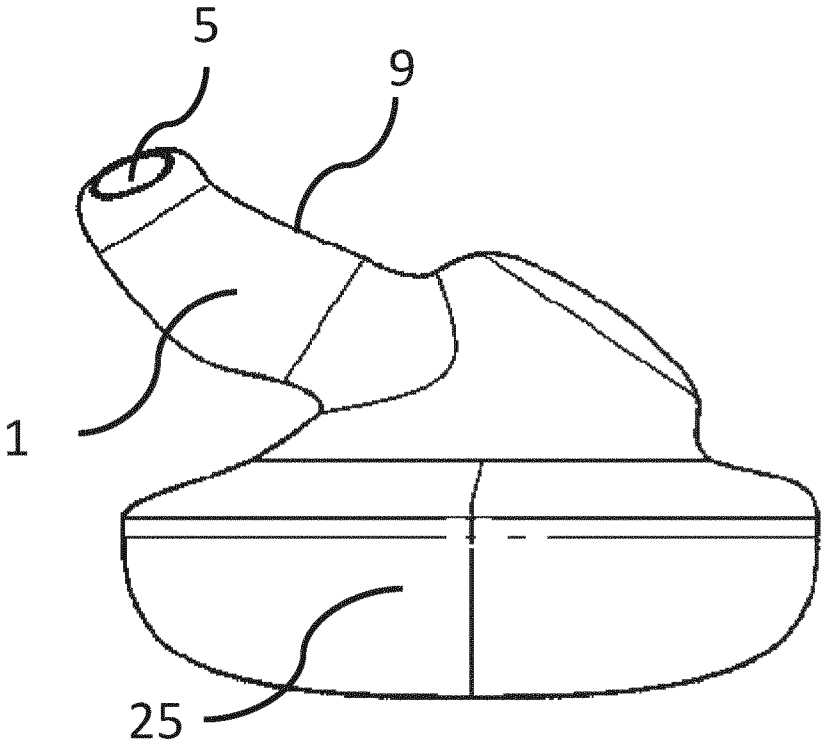

FIGS. 5*a* and 5*b* show an earpiece according to certain embodiments of the present invention including a tube (1). The second opening (5) of the tube (1) is illustrated within FIGS. 5*a* and 5*b* without material covering the opening such that recess (6) can be seen in FIG. 5*b*. Also illustrated is a housing (25) for the transducer. Within the embodiments shown, the tube provides support for the earpiece when the earpiece is inserted into the ear of an individual.

FIGS. 5*a* and 5*b* further illustrate an attachment means (9) for attaching the earpiece to the ear of a user. The attachment means may take the form of a portion of the earpiece surrounding the tube (1) comprised of a compressible material. The attachment means (9) may also comprise the shape of the housing (25) of the earpiece which allows it to fit snuggly in the ear of a person.

In certain embodiments of the present invention the point of measurement (15) is the point at which the acoustic sensor (10) measures properties of sound. In other embodiments the point of measurement (15) is the point in the tube (1) at which the acoustic sensor (10) is coupled to the tube (1).

According to some embodiments of the present invention there are a point of measurement (15) at the acoustic sensor (10) and an additional point of measurement (16) at the additional acoustic sensor (11).

In some embodiments the point of measurement (15) is a point between two acoustic sensors, for example, the midpoint between an acoustic sensor (10) and additional acoustic sensor (11).

Earpieces according to certain embodiments of the present invention may be further adapted to stay in the ear of an individual. These adaptations may include a traditional headband. Alternatively a behind-the-ear system may be employed to ensure the earpieces stay in place.

In embodiments having multiple acoustics sensors there may be, for example, two microphones. In those embodiments it is advantages to have the microphones separated by at least 4 mm, preferably separated by between 10 and 20 mm.

In certain embodiments there may be at least one microphone and at least one particle velocity sensor. In such embodiments the microphone and particle velocity sensor do not need to be separated. It is preferably that the microphone and particle velocity sensor be co-located.

The output signal of a particle velocity sensor is proportional to the acoustic particle velocity at the point of measurement. One example of such a device is the Microflown (www.microflown.com) particle velocity sensor that comprises a small-size hot-wire anemometer. The hot-wire anemometer consists of two closely spaced heated platinum wires that are exposed to airflow. The upstream wire is cooled down more by the airflow than the downstream wire, which affects the difference in the resistance of the wires. The difference is measured with a bridge circuit and a signal proportional to the particle velocity (in one direction) can thereby be obtained.

In the embodiment of FIG. 4 it can be seen that the tube (1) may take on a more com-plex curvature. In certain embodiments the curvature may be such that an S shape is formed. Other shapes and curvatures are possible such that the earpiece may fit in an individual's ear.

In certain embodiments of the present invention rapid changes in cross section area of the tube are avoided such that Equation 1 is still a valid approximation of the impedance throughout the tube.

$$Z = \rho * \frac{c}{A} \qquad \text{Equation 1}$$

In certain embodiments of the present invention the geometric and/or material properties of the tube (1) are such that the tube (1) is substantially lossless between the first opening and the second opening. In still further embodiments the tube is lossless such that the frequency response to acoustic energy measured at the first opening (4) upon supply of acoustic energy at the first opening (4) is within 2 dB of the frequency response of acoustic energy measured at the second opening (5). In certain embodiments this frequency response is measured with a ⅓ octave band resolution.

Within this application the audible frequencies are considered to be 20 Hz to 20000 Hz. In certain embodiments of the invention frequency responses are measured in the audible frequencies.

In certain embodiments of the invention the cross sectional area of the tube and the length of the tube are configured such that the tube will transmit plane waves at frequencies below 10000 Hz.

The terminal ends of the tube according to certain embodiments may refer to the 1 mm portion of tube at each end of the tube. It may also refer to the 1 mm of tube closest to the openings at either end of the tube. During manufacturing it may be beneficial to round the tube at the first and second opening. This rounding helps to ensure the tube will not cut an individual and increases user comfort. When the terminal ends of the tube are rounded thus they are not considered in the limitations of flaring angle. The terminal ends of the tube may also refer to the ends of the tube rounded in such a fashion.

In at least some embodiments of the invention a difference between the smallest cross sectional area of the tube and the largest cross sectional area is less than 30% of the smallest cross sectional area, preferably less than 15%.

Certain embodiments of the invention provide a substantially lossless acoustic transmission line between point of measurement and the eardrum of an individual.

In certain embodiments of the invention properties of the earpiece are determined and stored by the supplier. An estimation of the Thévenin type (or Norton type) source parameters of the earpieces is accomplished by using N acoustic load tubes with diameters between, e.g., 5 and 10 mm. The earpieces are coupled to the tubes after which the frequency responses induced by the earpieces are measured using the acoustic sensor (10). The earpiece tube section between the point of measurement and the second opening combined with each separate load tube constitute the N load impedances needed for the estimation of the source parameters. The impedance towards the source (Zs), as seen at the point of measurement, remains constant regardless of the diameter of the load tubes. The load impedance, as seen at the point of measurement, can be solved theoretically for each of the separate loads.

Certain embodiments of the invention provide for the determination of equalizer functions to be employed with a sound source coupled to the earpiece. In embodiments of the present invention wherein the sound source is coupled to the earpiece equalizer functions may be determined for at least those frequencies above 500 Hz, as those frequencies would be most impacted by the frequency functions.

The entrance of the ear canal as discussed herein may be a plane at the end of the flare of the ear canal. The entrance may also mean a point where the ear canal substantially begins. The entrance may also be considered the point at which the ear canal begins to have a substantially uniform diameter.

In certain embodiments of the invention there is further provided a dampening material between a sound source, such as a transducer, and the point of measurement. The dampening material provides benefits such as attenuating reflections from the source.

While certain embodiments of the present invention include a transducer coupled to the earpiece acting as a sound source, it is also possible that the sound source is a loudspeak-er.

According to certain embodiments of the present invention the geometric and/or material properties of the tube (1) are such that the frequency response to acoustic energy measured at the first opening (4) upon supply of acoustic energy at the first opening (4) is within 2 dB of the frequency response of the acoustic energy measured at the second opening (5). In certain embodiments the frequency response has a ⅓ octave band resolution.

In some embodiments of the present invention the tube has a cross sectional area which is between 3 mm2 and 79 mm2, preferably between 8 mm2 and 38 mm2.

An earpiece according some embodiments of the present invention further comprises a substantially acoustically transparent material (7) coupled to the second opening (5) so as to prevent particulate matter from entering the tube (1). In some embodiments the material properties of the substantially acoustically transparent material (7) are such that the frequency response to acoustic energy measured at a first side of the material upon supply of acoustic energy at the first side is within 2 dB of the frequency response of acoustic energy measured at a second side of the material.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the pur-pose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appear-ances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

TABLE 1

LIST OF REFERENCE NUMBERS.

| Number | Part |
|---|---|
| 1 | Tube |
| 2 | Outer Wall of Tube |
| 3 | Inner Wall of Tube |
| 4 | First Opening |
| 5 | Second Opening |
| 6 | Recess |
| 7 | Acoustically Transparent Material |
| 9 | Attachment Means |
| 10 | Acoustic Sensor |
| 11 | Additional Acoustic Sensor |
| 15 | Point of Measurement |
| 16 | Additional Point of Measurement |
| 20 | Transducer |
| 25 | Housing |
| 30 | External Load Impedance Tube |

TABLE 1-continued

| LIST OF REFERENCE NUMBERS. | |
|---|---|
| Number | Part |
| 40 | Earpiece |
| 50 | Model of an Ear Canal of an Individual |
| 51 | Canal Part |
| 52 | Eardrum Part |

SEQUENCE LISTING

Not Applicable.

The invention claimed is:

1. An earpiece comprising:

a tube made of a material and having a first opening at a first end where the tube material stops and a second opening at a second end where the tube material stops, an acoustic sensor coupled to the tube so as to be capable of measuring properties of sound inside the tube, and an attachment device configured to attach the earpiece to an ear of a user wherein, the acoustic sensor is arranged to measure sound within the tube at a point of measurement which is at least 2 mm from both the first opening and the second opening, and the second opening is capable of being at least partially inserted into the ear of a person.

2. The earpiece according to claim 1, further comprising a transducer coupled to the tube at the first opening.

3. The earpiece according to claim 1, wherein the earpiece is configured to be inserted into the ear of an individual such that the second opening is less than 4 mm from the entrance of the ear canal of the individual.

4. The earpiece according to claim 1, wherein excluding terminal ends of the tube, the largest flaring angle of the inner wall of the tube is less than 10 degrees.

5. The earpiece according to claim 1, wherein the geometric properties of the tube are such that the acoustic impedance of a progressive plane wave in the tube, at any point between the first opening and the second opening, is between 5 and 137 MPa·s/m3.

6. The earpiece according to claim 1, wherein the earpiece is curved.

7. The earpiece according to claim 1, wherein the tube is curved.

8. The earpiece according to claim 1, wherein the smallest radius of curvature of the tube, as measured from the center of the tube, is greater than the smallest diameter of the tube.

9. The earpiece according to claim 1, further comprising a recess in the inner wall of the tube wherein the acoustic sensor is positioned at least partially inside of the recess.

10. The earpiece according to claim 9, wherein, excluding terminal ends of the tube and the recess, the largest flaring angle of the inner wall of the tube is less than 10 degrees.

11. The earpiece according to claim 1, wherein there is at least 3 mm between the point of measurement and both the first opening and the second opening.

12. The earpiece according to claim 1, further comprising an additional acoustic sensor coupled to the tube so as to be capable of measuring acoustics inside of the tube at an additional point of measurement.

13. The earpiece according to claim 12, Wherein at least one of the acoustic sensor and additional acoustic sensor is a particle velocity sensor.

14. The earpiece according to claim 12, wherein the additional point of measurement is at least 4 mm.

15. The earpiece according to claim 12, wherein the additional point of measurement is between 10 mm and 20 mm from the point of measurement.

16. The earpiece according to claim 1, wherein the earpiece is acoustically lossless between the first opening and the second opening.

17. The earpiece according to claim 1, wherein excluding terminal ends of the tube, the largest flaring angle of the inner wall of the tube is less than 4 degrees.

18. The earpiece according to claim 1, wherein there is at least 7 mm between the point of measurement and both the first opening and the second opening.

19. The earpiece according to claim 1, wherein the geometric properties of the tube are such that the acoustic impedance of a progressive plane wave in the tube, at any point between the first opening and the second opening, is between 34 and 46 MPa·s/m3.

20. The earpiece according to claim 1, wherein the smallest radius of curvature of the tube, as measured from the center of the tube, is greater than two and a half times the smallest diameter.

* * * * *